US005951403A

United States Patent [19]

Trzos

[11] Patent Number: 5,951,403

[45] Date of Patent: Sep. 14, 1999

[54] HEMISPHERICAL ROLLING TOY

[76] Inventor: Irene Wanda Trzos, 3491 Mountainside Dr., Colorado Springs, Colo. 80918

[21] Appl. No.: 09/093,099

[22] Filed: Jun. 8, 1998

[51] Int. Cl.[6] ..... A63G 1/20

[52] U.S. Cl. ..... 472/25; 472/102

[58] Field of Search ..... 472/14, 25, 135, 472/114, 102

[56] References Cited

U.S. PATENT DOCUMENTS

| | | | |
|---|---|---|---|
| 1,357,940 | 11/1920 | Berry | 472/25 X |
| 2,826,424 | 3/1958 | Erickson | 472/25 X |
| 3,041,070 | 6/1962 | Kerstein | 472/25 |
| 3,380,735 | 4/1968 | Rigby | 472/25 |
| 3,477,713 | 11/1969 | Cudmore | 472/25 |
| 3,586,321 | 6/1971 | Gehrke et al. | 272/33 |
| 3,749,399 | 7/1973 | Fedor et al. | 472/25 |
| 4,076,235 | 2/1978 | Kisberg, Jr. | 272/33 A |
| 4,084,273 | 4/1978 | Haynes | 5/105 |
| 4,364,579 | 12/1982 | Fisher | 280/206 |
| 5,603,662 | 2/1997 | Kreaman-Stern | 472/25 |
| 5,643,165 | 7/1997 | Klekamp | 482/146 |

*Primary Examiner*—Kien T. Nguyen

[57] ABSTRACT

A hemispherically-shaped rolling toy for the amusement and exercise of children is disclosed. The invention is comprised of a hemispherically-shaped body made of a rigid material. The hemispherically-shaped body has a hollow interior which faces up to allow receipt of a child therein. The body has a rim which extends a predetermined distance outwardly, and upwardly at a predetermined angle relative to the vertical axis of the hemispherical body, forming a lip which is a deterrent to the possibility of the toy tipping over. A plurality of vertical slots horizontally encircle the body. A strap made of a strong material such as nylon is threaded through the vertical slots forming strap handles on the interior side of the device. The hollow interior is lined with a cushion made of a soft, pliant material such as foam. The cushion is covered by a liner made of an exposure-resistant material such as vinyl, the liner having an elasticized hem which secures the liner under the rim of the hemispherically-shaped body. Both cushion and liner have vertical cut-outs whose location and dimensions coincide with the vertical slots of the hemispherically-shaped body allowing the strap to be threaded through the liner, cushion, and body. The strap is secured on the exterior side of the hemispherically-shaped body with a fastener such as a buckle, clip, or the like.

8 Claims, 4 Drawing Sheets

HEMISPHERICAL ROLLING TOY

BACKGROUND OF THE INVENTION

This invention relates to a new and improved rolling toy for children and, specifically, pertains to providing amusement and exercise for a child through a safe and simply constructed hemispherical rolling toy.

Recreational toys pertaining to a rolling or rocking motion are known in the prior art. Although there are a number of rolling toys in a variety of designs and configurations devised for the purpose of providing entertainment and exercise for children, they have not become popular because of certain shortcomings in their design. For example, the issue of safety has not been addressed to the degree necessary to make these toys marketable. Some toys described in the prior art have no element in their design which acts as a deterrent to the rather high probability of the toy tipping over, possibly causing injury to a child. There is also prior art containing one or more handles or gripping bars which project from the body in such a manner as to possibly cause injury should a child meet such a protrusion with forceful contact. Still another example of prior art with a safety deficiency is one which is described as an annular-shaped device propelled by the occupant to rock and eventually roll completely over. This device does not provide any breaking means should the toy continue to roll and gather speed such as would occur on any downhill grade.

Another disadvantage of the prior art relates to the successful and smooth function of the rolling toy. For example, some such toys require at least two children for the operation of the toy. The successful attainment of a continuing rolling motion in this type of toy is highly dependent upon the weight variations of the two or more children. If the children's weights vary more than a few pounds, the rolling/rocking motion cannot be fluid and there is, again, a high probability of the toy tipping over.

Another disadvantage of some of the prior art pertaining to the successful and smooth function of the rolling toy is the shape of these devices. Various prior art describes a frustroconical or elliptical shape with a flattened bottom or rounded pivot point bottom. These toys are meant to be used by one child at a time, however, the overall shape and configuration of these devices do not facilitate as fluid a rolling motion as could be attained with an improved design.

Yet another disadvantage of the prior art relates to the high cost of manufacture of these devices which is due to the complexity of their designs and configurations. Therefore, there is a continuing need for a simpler construction which would achieve a better rolling action, safer utilization of the toy by children, and a lower cost of fabrication for the successful manufacture and marketing of such a toy.

By way of example, the following is a list of prior art disclosing a number of devices providing amusement and exercise for a child through a rolling or rocking device:

U.S. Pat. No. 5,603,662 to Kreaman-Stern discloses a hemispherical rocking toy with an annular seating surface divided into four equal areas, each for the receipt of a child.

U.S. Pat. No. 4,364,579 to Fisher discloses a rock and roll recreational toy with an annular body and gripping bar.

U.S. Pat. No. 4,076,235 to Risberg discloses an entertainment and exercise device having an elliptical configuration with a rounded bottom pivot point.

U.S. Pat. No. 3,586,321 to Gehrke discloses a balancing and exercising device comprised of an oval-shaped bowl with an oval, flattened bottom.

U.S. Pat. No. 5,643,165 to Klekamp discloses a frustroconical exercising device comprised of a saucer-shaped body with straps to secure the user thereon.

BRIEF SUMMARY OF THE INVENTION

In view of the continuing need for a new and improved design of a rolling toy for the amusement and exercise of children, the following is a description of my invention with discussion of the objects and advantages of my invention to follow:

My invention comprises, in combination, a hemispherically-shaped body made of a rigid material. The hemispherically-shaped body has a hollow interior. The rounded exterior surface rests on the ground and the hollow interior faces up so that it is accessible to the user. The rim of the hemispherical body extends outwardly a predetermined distance and upwardly at a predetermined angle relative to the vertical axis of the hemispherical body, forming a substantial lip around the entire top edge of the hemispherical body. The hollow interior of the hemispherical body is lined, first with a cushion made of foam or the like, then with a liner made of vinyl or canvas or the like. The material liner has an elasticized hem which extends over the lipped rim, then under the lipped rim to secure the liner to the hemispherical body. Approximately four to five inches below the lipped rim of the body are vertical slots horizontally encircling the body at alternating distances from each other of about three inches then twelve inches. The material liner and cushion are supplied with vertical cut-outs whose location and dimensions coincide with the vertical slots of the hemispherically-shaped body. The purpose of these vertical slots and cut-outs is to allow a strap, made of a pliant, soft material such as nylon or the like to be threaded through them to form strap handles on the interior side of the toy. A fastener such as a buckle or clip or the like secures the strap on the exterior side of the toy. The threaded strap also serves to hold the cushion and liner securely to the hemispherically-shaped body.

Addressing the issue of safety there are several features of my invention which result in an improved safety environment. The extended lipped rim of the hemispherically-shaped body substantially deters the toy from tipping over. The cushion and material liner lining the hollow interior of the body provide comfort and soften any forceful contact the child may experience due to enthusiastic use and protects the child from bruising as a result of extended use of the toy. The child is positioned within the hollow interior of the body holding the strap handles with his/her hands and, dependent upon which position the child chooses, also has the option of sliding his/her feet under the straps. The child has a variety of choices regarding positioning within the toy including sitting, kneeling, lying in a somewhat folded position or whatever position the child's imagination will suggest. Because the child is low to the ground, and never is in a raised position such as in some of the rocking devices of the prior art, the child cannot fall any great distance likely to cause injury. The rolling motion in my invention is achieved as the child shifts his/her weight in a back and forth or circular motion. Should the rolling be done at an enthusiastic speed, the lipped rim, as mentioned above, substantially protects the child from tipping over with the toy.

Another improvement of my invention over the prior art is the use of strap handles as opposed to handles or grip bars made of metal or a rigid plastic which project from the body of the toy. The strap handles of my invention do not protrude at all and are made of a soft material to protect the child from injury in the event of forceful contact.

Another disadvantage previously stated of the prior art relates to the successful and smooth function of the rolling toy. The hemispherical shape without a flattened or narrow pivot point bottom, accomplishes a very smooth rolling action which is facilitated by the simple rounded shape of a half-sphere. Since my invention is intended for the use of one child at a time, there is no question of dependency upon the varying weights of another child or children. As mentioned above, the child is never in a raised position such as in some toys of the prior art, and is therefore, less likely to be in a situation where tipping over is imminent, interrupting the smooth flow of the rolling action. The number and placement of the strap handles also serve to facilitate the smooth function of the rolling toy. The child has a wide choice of placement of his/her hands and feet within the strap handles. As a result, the shifting of the child's weight is accomplished with ease and firm control of the toy. Since the cushion provides comfort to the child's body, the flow of the rolling action is not interrupted due to the child's discomfort. The child may roll around happily for as long as he/she wishes and will find it a pleasant sensation as well as good exercise.

The simple configuration of my invention, a half-sphere with an extended lipped rim, is an advantage over the prior art from the standpoint of cost of manufacture. The interior of this toy is hollow and the thickness of the body need only be sufficient to give it the required rigidity. The simplicity of the configuration minimizes the cost of manufacture as pertains to complexity of design and the amount of material needed to fabricate the device. The material needed to fabricate the cushion, material liner, strap, and fastener are all readily available and inexpensive items.

Other advantages of my invention include the following:

1. The toy is lightweight and easily maneuvered even by a child.

2. Because of the configuration of the toy, a number of them can be easily stacked for storage at home or in a store when on display.

3. The strap and material liner are removable to facilitate ease of cleaning.

Further objects and advantages of my invention will become apparent from a consideration of the drawings and ensuing description.

DETAILED DESCRIPTION OF THE INVENTION

Figure 1:
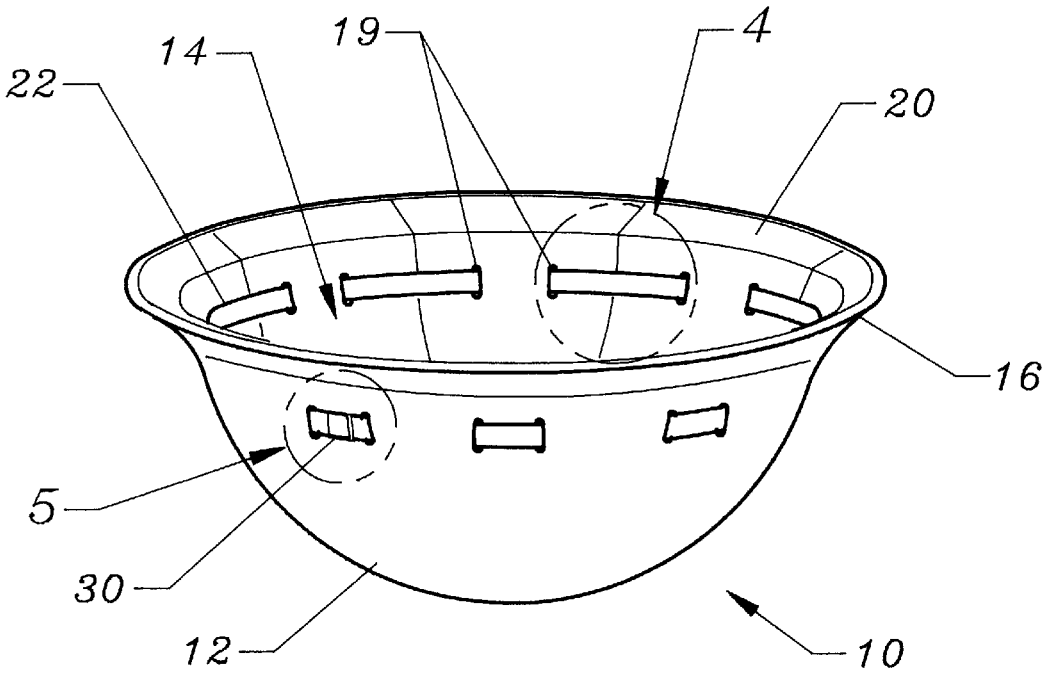
FIG. 1 is a perspective view of the preferred embodiment of the new and improved hemispherical rolling toy.

Referring to FIG. 1, a hemispherically-shaped rolling toy, indicated generally at 10 whose object is to provide amusement and exercise for children with every effort being made to insure the safety of the child from injury to the greatest degree possible, and to present this toy in a simplified design using readily-available and inexpensive materials to enable the successful manufacture and marketing of this device.

The present invention is comprised of a number of elements. In their broadest context the elements include a hemispherically-shaped body 12, with a hollow interior 14, a lipped rim 16, a cushion 26 lining the hollow interior 14, a material liner 20 covering the cushion 26, and a strap 22 threaded through the aforementioned hemispherically-shaped body 12, cushion 26, and material liner 20 to form strap handles.

Figure 2:
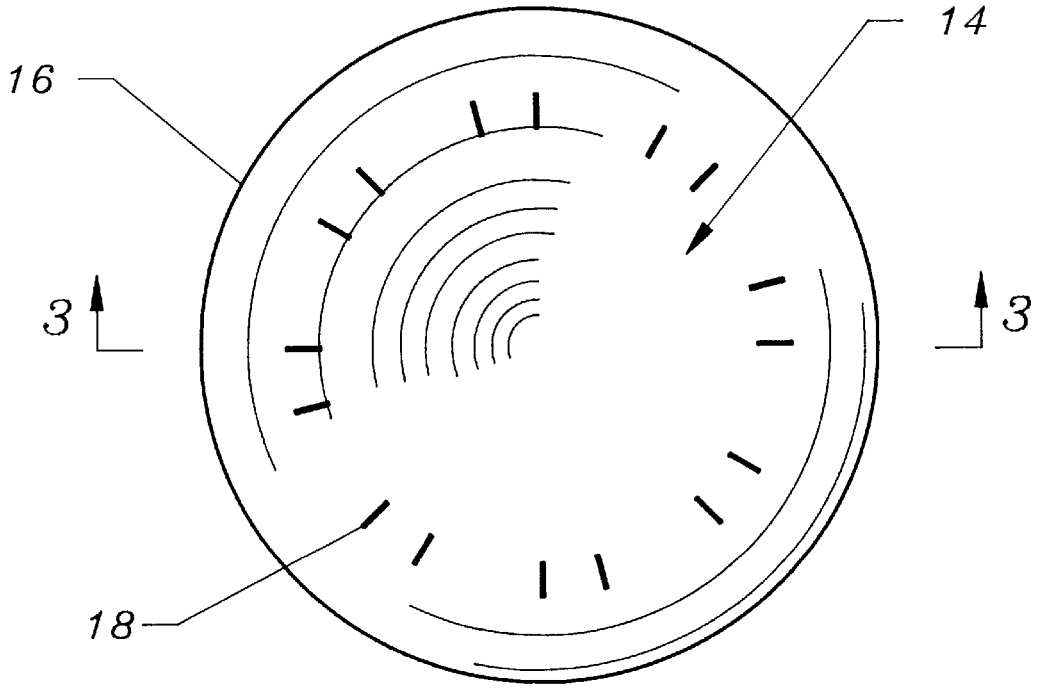
FIG. 2 is a top plan view of the device shown in FIG. 1 without the cushion, material liner, and strap.
Figure 3:
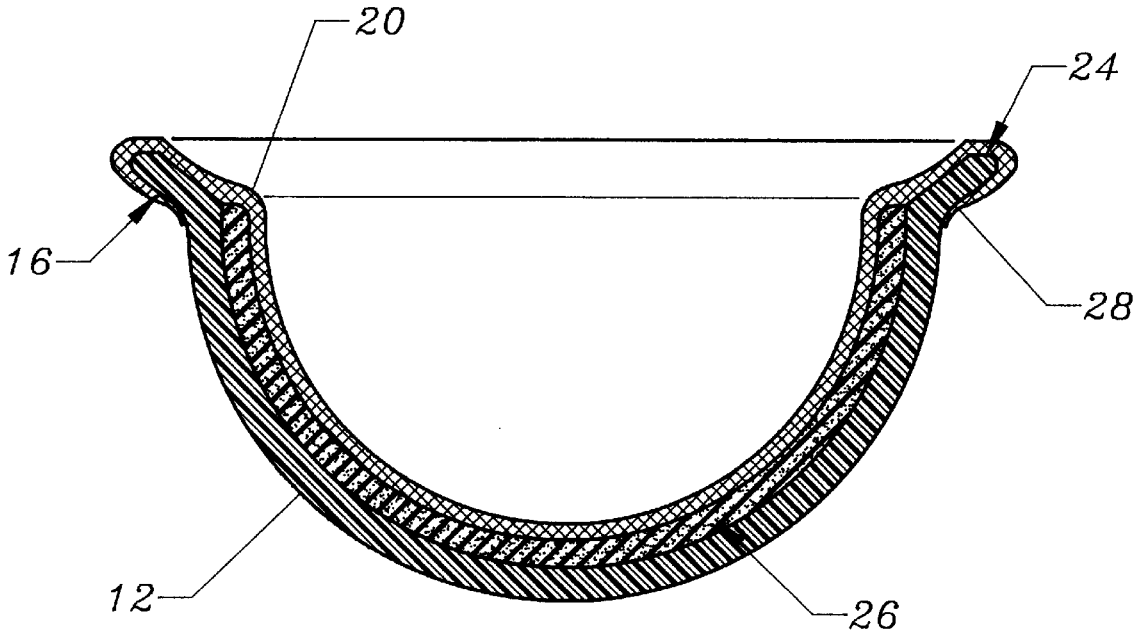
FIG. 3 is a cross-sectional view taken along line 3—3 of FIG. 2 showing the invention with the cushion and material liner.
Figure 4:
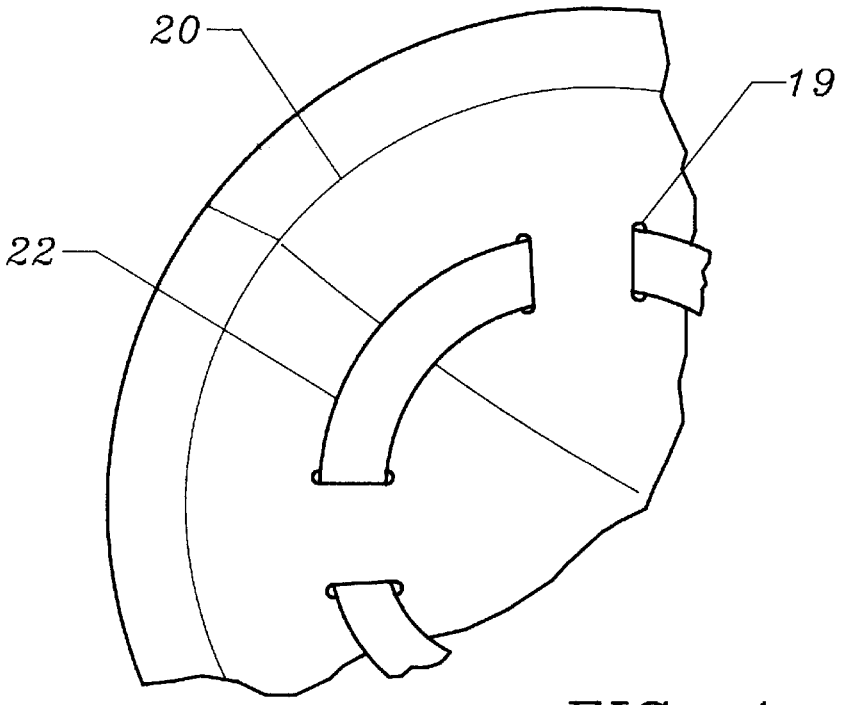
FIG. 4 is an enlarged view of the interior surface of the hemispherically-shaped body with the strap threaded through the body, cushion, and material liner of the invention.

The principal element of this toy, as shown in FIGS. 1–3, is the hemispherically-shaped body 12 with a hollow interior 14. There are a number of materials which could be used to fabricate the hemispherically-shaped body, however, a rigid plastic is preferred. The rounded exterior surface of the hemispherically-shaped body 12 rests on the ground and the hollow interior 14 faces up for the receipt of one child therein. The diameter of the hemispherically-shaped body 12 is approximately thirty-six inches and the depth is approximately eighteen inches.

The next important element of this invention, as shown in FIGS. 1–3, is the lipped rim 16 which extends outwardly a predetermined distance, approximately three to five inches, and upwardly at a predetermined angle, approximately forty-five degrees, relative to the vertical axis of the hemispherically-shaped body 12. The lipped rim 16 has rounded corners 24, as shown in FIG. 3.

FIGS. 1,2,4,5, and 6 show the location of vertical slots 18 cut into the hemispherically-shaped body 12. The vertical slots 18 are located approximately four to five inches below the lipped rim 16 and horizontally encircle the hemispherically-shaped body 12 at alternating distances of approximately three inches, then twelve inches. These vertical slots 18 are approximately two inches in height and one-fourth inch in width.

Lining the hollow interior 14 of the hemispherically-shaped body 12 is a cushion 26 as shown in FIG. 3. The cushion 26 may be made of any soft, pliant material, however, a foam material with a thickness of approximately one inch is preferred. The cushion 26 is supplied with vertical cut-outs 25 whose location and dimensions coincide with the vertical slots 18 of the hemispherically-shaped body 12, as shown in FIGS. 1,2,4,5, and 6.

FIG. 3 also shows a liner 20 fabricated of a durable exposure-resistant material such as vinyl or canvas. This material liner 20 covers the cushion 26 lining the hollow interior 14 of the hemispherically-shaped body 12. The liner 20 extends over the lipped rim 16, then under the lipped rim 16 of the hemispherically-shaped body 12 and has an elasticized hem 28 which securely fastens the liner 20 to the hemispherically-shaped body 12, as shown in FIG. 3. The liner 20 is supplied with vertical cut-outs 19 whose location and dimensions coincide with the vertical cut-outs 25 of the cushion 26 and the vertical slots 18 of the hemispherically-shaped body 12.

Figure 5:
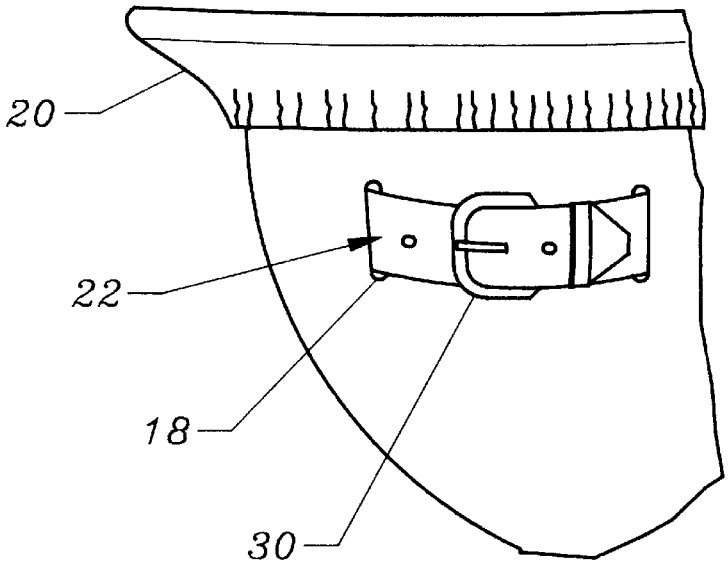
FIG. 5 is an enlarged view of the exterior surface of the hemispherically-shaped body with the strap threaded through the body, cushion, and material liner of the invention and showing the fastener securing the strap.
Figure 6:
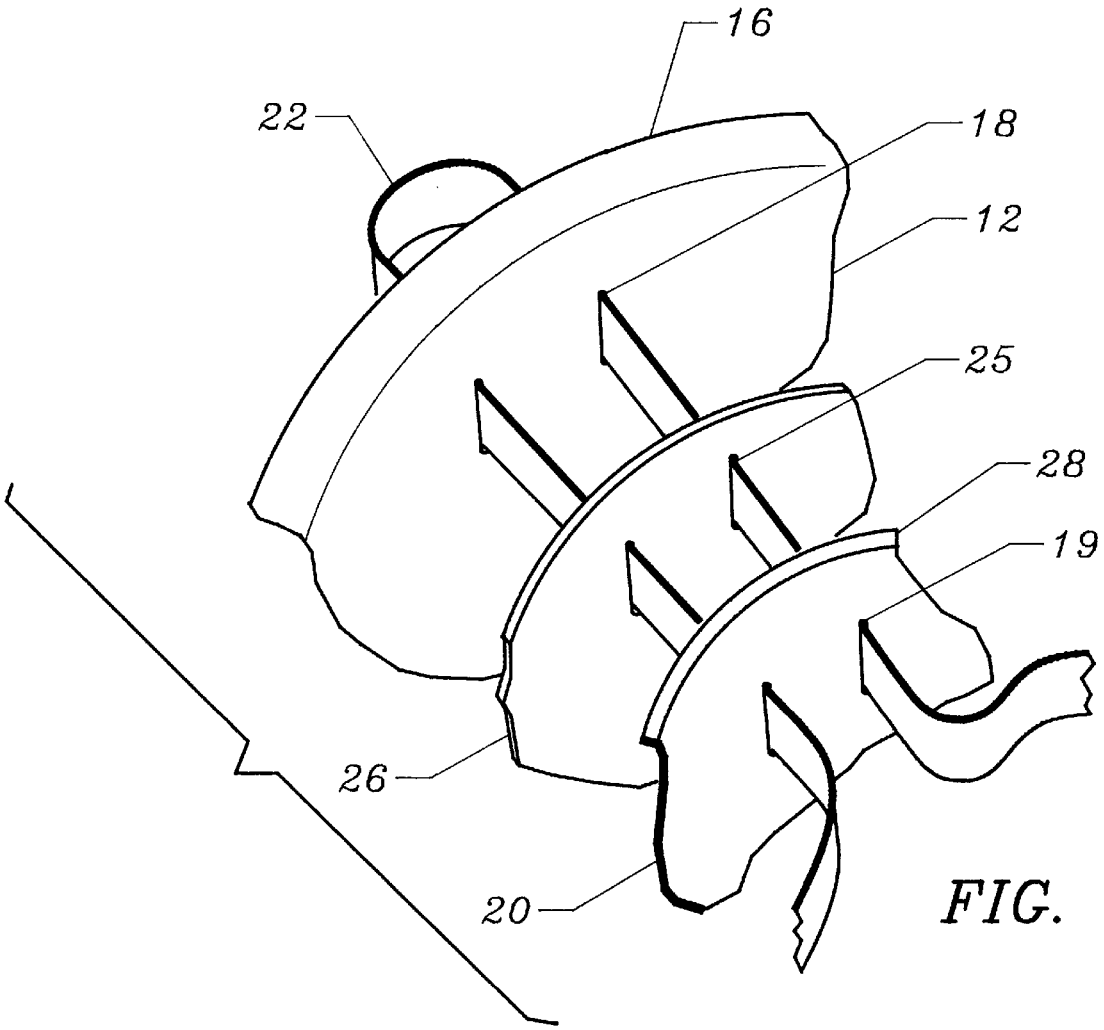
FIG. 6 is an exploded perspective view of the strap, liner, and cushion, and the vertical slots of the hemispherically-shaped body.

The last element of this invention is a strap 22 made of a strong, flexible, and soft material such as nylon. The strap 22 is approximately two inches wide and sufficient in length to be threaded through the vertical slots 18 of the hemispherically-shaped body 12, the vertical cut-outs 25 of the cushion 26, and the vertical cut-outs 19 of the liner 20. The strap 22, when it is threaded in this manner, forms a plurality of strap handles on the interior side of the toy, each handle being approximately eleven inches in length. The strap 22 is secured on the exterior side of the toy by means of a fastener 30, such as a buckle or clip, as shown in FIG. 5. The threaded strap 22 also serves to hold the cushion 26 and the liner 20 securely to the hemispherically-shaped body 12.

Figure 7:
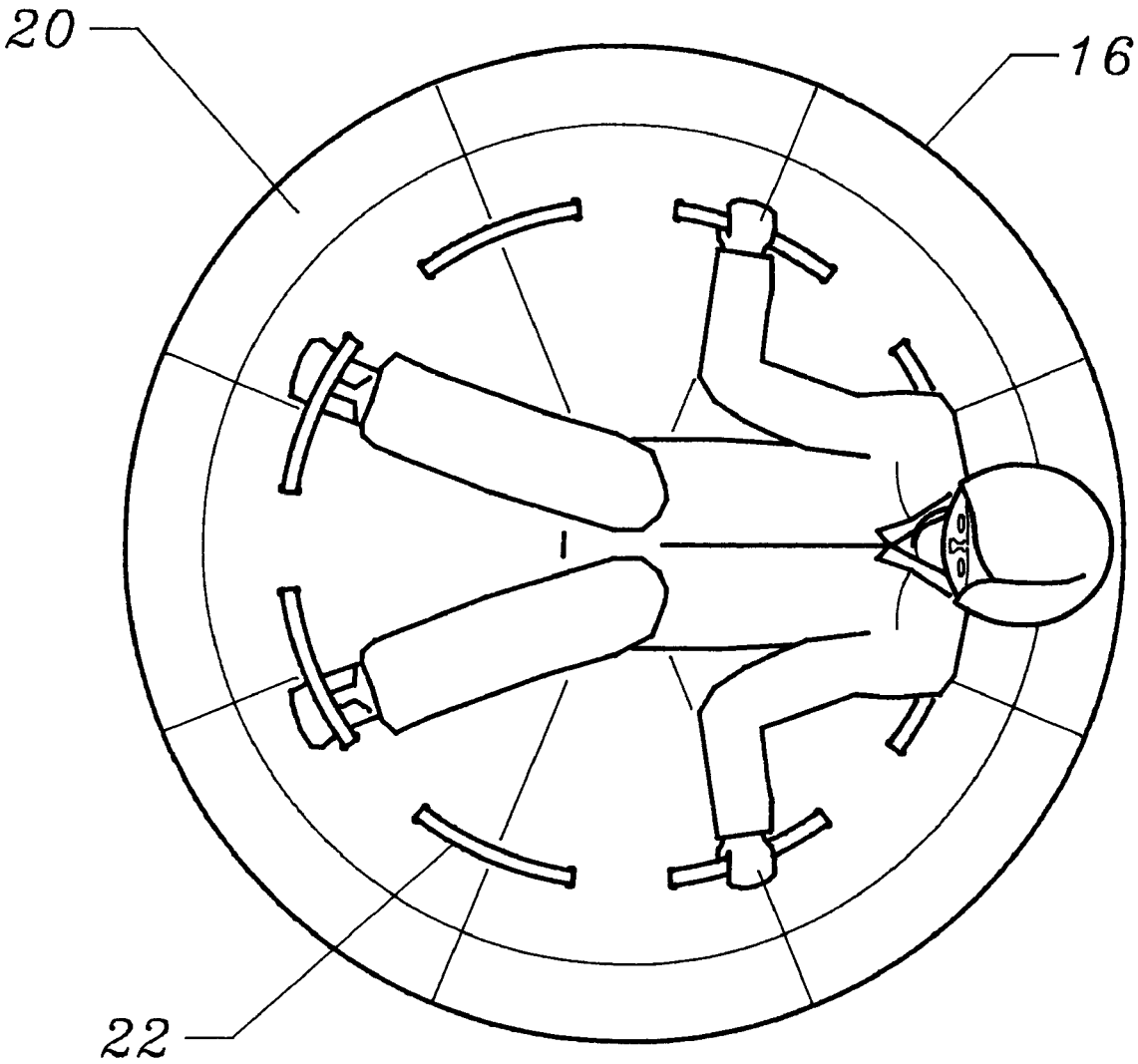
FIG. 7 is a top view of the invention with a child situated therein by way of example of just one of the various positions which may be utilized.

The present invention comprises a rolling toy which is to be used by one child at a time. The rolling action is facilitated by the child shifting his/her weight in a circular motion. Depending upon the speed and enthusiasm of the rolling action, the toy will stay in its general location or travel around the play area. This device can be utilized on most surfaces such as grass, concrete or snow. The lipped rim is a substantial deterrent to tipping over of the toy, and, as such, is an important element of the invention. Although the device can be utilized without the cushion and material liner, they provide comfort and an element of safety to the child's body, and as such, their presence is preferred. The handles formed by the threaded strap provide a variety of possibilities as pertains to the positioning and firm control of the child within the hemispherically-shaped toy. The child's hands can grip the handles either to the front of the child, the sides of the child, or behind the child. The child's feet can slide under the strap handles further securing the child within the interior of the toy while enabling the child to have firm control of the toy's rolling action. FIG. 7 shows one such position by way of example. The strap, being made of a soft material and not projecting in any way towards the child's body, furthers the degree of safety to the child which is an object of this invention.

It has long been known that a rolling motion is a pleasant sensation to a child and can be facilitated with this invention either enthusiastically for the child's amusement, or gently for the child's relaxation. Since the child is always low to the ground, there is no danger of the child falling from any great height. Thus, the reader will see that the hemispherical rolling toy of this invention provides an amusement device for children with the potential of many hours of enjoyment, while also providing elements which further the safety of the child. The design and configuration of the invention is simple and, therefore, can be economically fabricated to facilitate the successful manufacture and marketing of this toy.

While my above description contains many specificities, these should not be construed as limitations on the scope of the invention, but rather as an exemplification of one preferred embodiment thereof. Accordingly, the scope of the invention should be determined not by the embodiment illustrated, but by the appended claims and their legal equivalents.

What I claim as my invention is:

1. A new and improved rolling amusement device for children comprising, in combination:

(a) a hemispherically-shaped unit made of a rigid material, said hemispherically-shaped unit having a hollow interior large enough for the receipt of one child therein, said hemispherically-shaped unit resting on the rounded exterior surface with the hollow interior surface accessible from the top;

(b) a lip formed along the rim of said hemispherically-shaped unit projecting outwardly and upwardly at a predetermined angle relative to the vertical axis of said hemispherically-shaped unit, said lip extending a predetermined length sufficient to providing a means of deterring said hemispherically-shaped unit from tipping over;

(c) a plurality of vertical slots horizontally encircling said hemispherically-shaped unit at a predetermined location below the lipped rim of said hemispherically-shaped unit, said vertical slots being spaced apart a predetermined distance, a strap being threaded through said vertical slots resulting in a plurality of strap handles formed on the interior surface of said hemispherically-shaped unit, said strap being secured on the exterior side of said hemispherically-shaped unit with a fastener.

2. The amusement device of claim 1, further including a cushion lining the interior surface of said hemispherically-shaped unit, said cushion being supplied with vertical cut-outs whose location and dimensions coincide with said vertical slots horizontally encircling said hemispherically-shaped unit, allowing said strap to be threaded through said vertical cut-outs of said cushion and said vertical slots of said hemispherically-shaped unit.

3. The amusement device of claim 1, further including:

(a) a cushion lining the interior surface of said hemispherically-shaped unit, said cushion being supplied with vertical cut-outs whose location and dimensions coincide with said vertical slots horizontally encircling said hemispherically-shaped unit;

(b) a liner covering said cushion, said liner being supplied with vertical cut-outs whose location and dimensions coincide with said vertical cut-outs of said cushion and with said vertical slots horizontally encircling said hemispherically-shaped unit, allowing said strap to be threaded through said liner, said cushion, and said vertical slots of said hemispherically-shaped unit to form said strap handles, said liner having an elasticized hem which extends over said lip, then under said lip of said hemispherically-shaped unit resulting in said liner being securely fastened to said hemispherically-shaped unit.

4. The amusement device of claim 1, wherein said hemispherically-shaped unit is made of a rigid plastic approximately one inch thick, and said hemispherically-shaped unit having an approximate diameter of thirty-six inches and an approximate depth of eighteen inches.

5. The amusement device of claim 1, wherein said lip of said hemispherically-shaped unit projects outwardly and upwardly at approximately a forty-five degree angle relative to the vertical axis of said hemispherically-shaped unit, said lip extending approximately three to five inches to provide a means of deterring said hemispherically-shaped unit from tipping over, and said lip being formed with rounded corners as a deterrent to injury.

6. The amusement device of claim 1, wherein said vertical slots are located approximately four to five inches below the lipped rim of said hemispherically-shaped unit, said vertical slots being spaced apart horizontally in alternating lengths of approximately three inches, then twelve inches, said vertical slots being approximately two inches in height and one-fourth inch in width.

7. The amusement device of claim 1, wherein said strap is approximately two inches wide and of a sufficient length to be threaded through said vertical slots of said hemispherically-shaped unit, each said strap handle being approximately eleven inches in length, and said strap being secured on the exterior side of said hemispherically-shaped unit with a fastener.

8. A new and improved rolling amusement device for children comprising, in combination:

(a) a hemispherically-shaped unit made of a rigid material, said hemispherically-shaped unit having a hollow interior large enough for the receipt of one child therein, said hemispherically-shaped unit resting on the rounded exterior surface with the hollow interior accessible from the top;

(b) a lip formed along the rim of said hemispherically-shaped unit projecting outwardly and upwardly at a predetermined angle relative to the vertical axis of said hemispherically-shaped unit, said lip extending a predetermined length sufficient to providing a means of deterring said hemispherically-shaped unit from tipping over;

(c) a plurality of vertical slots horizontally encircling said hemispherically-shaped unit at a predetermined location below the lipped rim of said hemispherically-shaped unit, said vertical slots being spaced apart a predetermined distance, a strap being threaded through said vertical slots resulting in a plurality of strap handles formed on the interior surface of said hemispherically-shaped unit, said strap being secured on the exterior side of said hemispherically-shaped unit with a fastener;

(d) a cushion lining the interior surface of said hemispherically-shaped unit, said cushion being supplied with vertical cut-outs whose location and dimensions coincide with said vertical slots horizontally encircling said hemispherically-shaped unit, allowing said strap to be threaded through said vertical cut-outs of said cushion and said vertical slots of said hemispherically-shaped unit to form said strap handles;

(e) a liner covering said cushion, said liner being supplied with vertical cut-outs whose location and dimensions coincide with said vertical cut-outs of said cushion and with said vertical slots of said hemispherically-shaped unit, allowing said strap to be threaded through said liner, said cushion, and said vertical slots of said hemispherically-shaped unit to form said strap handles, said liner having an elasticized hem which extends over the lipped rim, then under the lipped rim of said hemispherically-shaped unit resulting in said liner being securely fastened to said hemispherically-shaped unit.

* * * * *